US011162509B2

(12) United States Patent
Dietrich

(10) Patent No.: US 11,162,509 B2
(45) Date of Patent: Nov. 2, 2021

(54) TURBOCHARGER AND TURBINE HOUSING THEREFOR

(71) Applicant: BorgWarner Inc., Auburn Hills, MI (US)

(72) Inventor: Konstantin Dietrich, Mainz (DE)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 16/808,560

(22) Filed: Mar. 4, 2020

(65) Prior Publication Data

US 2020/0291957 A1 Sep. 17, 2020

(30) Foreign Application Priority Data

Mar. 11, 2019 (DE) ..... 102019001798.6

(51) Int. Cl.

| | |
|---|---|
| ***F04D 17/10*** | (2006.01) |
| ***F04D 29/42*** | (2006.01) |
| ***F02B 37/00*** | (2006.01) |
| ***F01N 3/28*** | (2006.01) |
| ***F01N 13/18*** | (2010.01) |

(52) U.S. Cl.

CPC ..... *F04D 29/4206* (2013.01); *F01N 3/28* (2013.01); *F01N 13/1805* (2013.01);

(Continued)

(58) Field of Classification Search

CPC .. F04D 17/10; F04D 29/4209; F04D 29/4206; F02B 37/00; F01N 3/28;

(Continued)

(56) References Cited

U.S. PATENT DOCUMENTS 5,579,643 A * 12/1996 McEwen ..... F02B 37/18 60/602
6,767,185 B2 * 7/2004 Martin ..... F01D 9/026 415/205

(Continued)

FOREIGN PATENT DOCUMENTS

| | | | |
|---|---|---|---|
| DE | 102011004345 | A1 | 8/2012 |
| EP | 3267006 | A1 | 1/2018 |
| WO | 2009118471 | A1 | 10/2009 |

OTHER PUBLICATIONS

Machine-Assisted English language abstract and Machine-Assisted English language translation for DE 10 2011 004 345 extracted from espacenet.com database on May 11, 2020, 6 pages.

(Continued)

*Primary Examiner* — Audrey B. Walter
(74) *Attorney, Agent, or Firm* — Howard & Howard Attorneys PLLC

(57) ABSTRACT

A turbine housing for a turbocharger includes an inlet passage and an outlet passage connected to a turbine housing body. The outlet passage has a longitudinal axis and comprises a first section and a second section downstream of the first section. The first section includes a first inlet opening having a first cross-sectional area, a first outlet opening downstream of the first inlet opening, and a first length between the first inlet opening and the first outlet opening, wherein the first section has an opening angle between 0° and 10° relative to the longitudinal axis along the first length. The second section downstream of the first section includes a second inlet opening, a second outlet opening downstream of the second inlet opening, a second cross-sectional area at least 1.8 times greater than the first cross-sectional area, and a second length between the second inlet opening and the second outlet opening that is less than 50% of the first length.

8 Claims, 5 Drawing Sheets

(52) U.S. Cl.
CPC ..... *F02B 37/00* (2013.01); *F04D 17/10* (2013.01); *F01N 2340/06* (2013.01); *F05D 2250/232* (2013.01); *F05D 2250/27* (2013.01); *F05D 2250/324* (2013.01)

(58) Field of Classification Search
CPC ..... F01N 13/1805; F01N 2340/06; F05D 2250/232; F05D 2250/27; F05D 2250/324
See application file for complete search history.

(56) References Cited

U.S. PATENT DOCUMENTS

| | | | | |
|---|---|---|---|---|
| 9,689,397 | B2 * | 6/2017 | Edwards | F01D 25/30 |
| 2012/0312011 | A1 * | 12/2012 | Romblom | F02M 26/06 60/605.1 |
| 2013/0000300 | A1 * | 1/2013 | O'Hara | F02B 37/22 60/605.2 |
| 2019/0010854 | A1 * | 1/2019 | Kimura | F02B 37/02 |

OTHER PUBLICATIONS

Machine-Assisted English language abstract and Machine-Assisted English language translation for EP 3 267 006 extracted from espacenet.com database on May 11, 2020, 11 pages.
Machine-Assisted English language abstract and Machine-Assisted English language translation for WO 2009/118471 extracted from espacenet.com database on May 11, 2020, 10 pages.

* cited by examiner

| | Design 1 | Design 2 | Design 3 |
|---|---|---|---|
| Rated Power | | | |
| $\Delta_{pt}$ [mbar] | 146 | 202 | 246 |
| $\eta_{Pe}$ [-] | 0.584 | 0.545 | 0.521 |
| $P_{Pe}$ [kW] | 180.909 | 171.371 | 164.707 |
| Rated Torque | | | |
| $\Delta_{pt}$ [mbar] | 80 | 75 | 73 |
| $\eta_{Md}$ [-] | 0.597 | 0.607 | 0.610 |
| $P_{Md}$ [kW] | 33.809 | 33.980 | 34.052 |
| Cat lightoff | | | |
| ΘCAT[-] | 0.242 | 0.239 | 0.234 |
| |  |  |  |

TURBOCHARGER AND TURBINE HOUSING THEREFOR

CROSS-REFERENCE TO RELATED APPLICATIONS

The present application claims priority to and all the benefits of German Application No. 102019001798.6 filed on Mar. 11, 2019 which is hereby expressly incorporated herein by reference in its entirety.

TECHNICAL FIELD

The present disclosure relates to a turbocharger for an internal combustion engine. More particularly, the present disclosure relates to a turbine housing for a turbocharger and to a turbocharger comprising this turbine housing.

BACKGROUND

Turbochargers deliver compressed air to an intake of an internal combustion engine, allowing more fuel to be combusted. As a result, a power density of the engine is increased without significantly increasing engine weight. Turbochargers thus permit the use of smaller engines that develop the same amount of power as larger, normally aspirated engines. Using a smaller engine in a vehicle has the desired effect of decreasing the vehicle mass, increasing performance and reducing fuel consumption. Moreover, the use of turbochargers leads to an improved combustion and, therefore, to reduced emissions.

Turbochargers include a turbine housing having an inlet passage connected to an exhaust manifold of the engine, a compressor housing having an outlet passage connected to an intake manifold of the engine, and a bearing housing interconnecting the turbine housing and the compressor housing. An exhaust gas flow from the exhaust manifold rotatably drives a turbine wheel in the turbine housing. The turbine wheel is connected via a rotor shaft rotatably supported in the bearing housing to a compressor wheel in the compressor housing. Rotation of the turbine wheel by the exhaust gas flow thus causes rotation of the compressor wheel so as to deliver compressed air to the intake manifold.

After having driven the turbine wheel, the exhaust gas flow is discharged from the turbine housing via an outlet passage, also referred to as exducer. The outlet passage often has a conical shape and opens out into a flange for connecting the turbocharger to a catalytic converter assembly.

The design of turbochargers needs to consider packaging constraints in the engine compartment of a vehicle. Such packaging constraints are particularly pronounced when a turbocharged combustion engine is combined with an electric motor to form a hybrid system.

One possibility to cope with packaging constraints in the turbocharger design is to reduce the exducer length, i.e., the length of the outlet passage of the turbine housing. Reducing the outlet passage length however not only impacts turbine performance but also performance of the catalytic converter downstream of the outlet passage.

SUMMARY

There is a need for a turbine housing that can easily accommodate packaging constraints without negatively impacting performance parameters.

According to one aspect of the present disclosure, a turbine housing for a turbocharger is presented. The turbine housing comprises a turbine housing body configured to house a turbine wheel, an inlet passage connected to the turbine housing body and configured to receive an exhaust gas flow and direct the exhaust gas flow into the turbine housing body, and an outlet passage connected to the turbine housing body and configured to discharge the exhaust gas flow. The outlet passage has a longitudinal axis and comprises a first section. The first section includes a first inlet opening configured to receive the exhaust gas flow from the turbine housing body and having a first cross-sectional area, a first outlet opening downstream of the first inlet opening and configured to discharge the exhaust gas flow from the first section, and a first length between the first inlet opening and the first outlet opening, wherein the first section has an opening angle from 0° to 10° relative to the longitudinal axis along the first length. The outlet passage further comprises a second section downstream of the first section and including a second inlet opening configured to receive the exhaust gas flow from the first section, a second outlet opening downstream of the second inlet opening and configured to discharge the exhaust gas flow from the turbine housing, the second outlet opening having a second cross-sectional area that is at least 1.8 times greater than the first cross-sectional area, and a second length between the second inlet opening and the second outlet opening, wherein the second length is less than 50% of the first length.

An opening angle of 0° corresponds to a substantially cylindrical, or tubular, shape of the first section. In some variants, the first section may have an opening angle greater than 0°. The opening angle may be smaller than 7° or smaller than 5°.

In some variants, the second length is less than 30% of the first length. For example, the second length can be less than 25% or less than 20% of the first length. The second length can be more than 5% of the first length.

In some variants, the second cross-sectional area is at least 2.2 times greater than the first cross-sectional area. For example, the second cross-sectional area can be at least 3, 4 or 5 times greater than the first cross-sectional area. In some variants, the second cross-sectional area can be less than 6 times greater than the first cross-sectional area.

The second section of the outlet passage may comprise a first sub-section defining the second inlet opening and flaring outwardly. The second section may further comprise a second sub-section downstream of the first sub-section and defining the second outlet opening. The second sub-section may be immediately adjacent to the first sub-section. The second section may consist of the first sub-section and the second sub-section.

The first sub-section may flare outwardly at a predefined radius of curvature. In some variants, the radius of curvature is from 0.3 cm to 4 cm (e.g., from 0.7 cm to 2 cm).

At least a first portion of the second sub-section may have a linearly increasing diameter. The first portion may thus be conically shaped.

At least a second portion of the second sub-section may flare inwardly. As a result of the first sub-section flaring outwardly, the second outlet passage section may thus have an S-shape in a cross-sectional view.

In some variants, an internal wall of the second sub-section may merge at a tangential angle from 80° to 90° into a plane that extends parallel to the second outlet opening. The second outlet opening may lie in that plane or may be spaced apart from that plane.

In other variants, the internal wall of the second sub-section may merge at a tangential angle from 0° to 10° into the plane that extends parallel to the second outlet opening. The second outlet opening may lie in that plane or may be spaced apart from that plane.

The second outlet passage section may define a flange configured to connect the outlet passage to a catalytic converter assembly. The flange may be provided with one or more connection structures such as through-bores to receive attachment bolts.

The turbine housing may further comprise a plurality of guide vanes defining flow channels from the inlet passage into the turbine housing body. At least some of the guide vanes may be adjustable so as to change a respective cross-section of at least some of the flow channels. The guide vanes may define a so-called Variable Turbine Geometry (VTG).

The first section may be rotationally symmetric relative to the longitudinal axis. Additionally, or in the alternative, the second section may be rotationally symmetric relative to the longitudinal axis. In some variants, the second section may not be rotationally symmetric to the longitudinal axis or any other axis. For example, the outlet opening may have an asymmetric (e.g., non-circular) shape that leads to an asymmetric shape of the second section.

In some implementations, no lateral openings are provided in any of the first section and the second section. In particular, a lateral wall of the outlet passage may be defined by a closed surface. In other words, no openings (e.g., for a waste gate) may be provided in that lateral wall.

According to a second aspect of the present disclosure, a turbocharger is provided. The turbocharger comprises a compressor housing, the turbine housing as presented herein, and a bearing housing arranged between and connected to the compressor housing and the turbine housing.

BRIEF DESCRIPTION OF THE DRAWINGS

Additional aspects and advantages of the present disclosure will be readily appreciated by reference to the following detailed description when considered in connection with the accompanying drawings, wherein.

DETAILED DESCRIPTION

Figure 1:
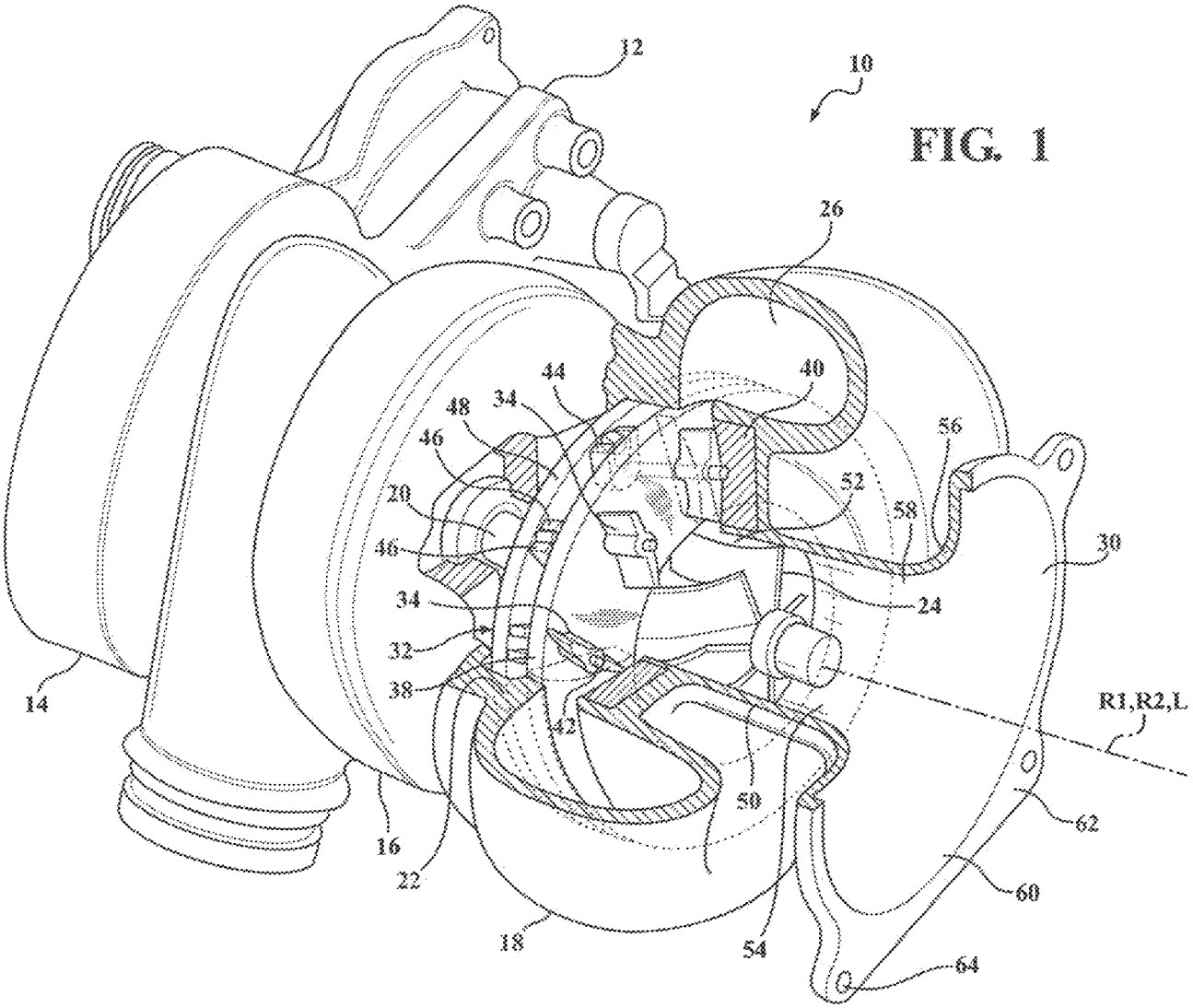
FIG. 1 is a partially-sectioned perspective view of a turbocharger with a turbine housing according to one embodiment of the present disclosure.

FIG. 1 illustrates a partially-sectioned perspective view of a turbocharger 10 for an internal combustion engine. The turbocharger 10 includes a housing assembly 12 consisting of a compressor housing 14, a bearing housing 16, and a turbine housing 18 that are connected to each other. The bearing housing 16 supports a rotatable shaft 20 that defines a turbine axis of rotation R1. A compressor wheel (not shown) having a plurality of blades is mounted on one end of the shaft 20 and is housed within the compressor housing 14. The turbine housing 18 has a turbine housing body 22 that houses a turbine wheel 24 having a plurality of blades. The turbine wheel 24 is mounted on an opposite end of the shaft 20 in relation to the compressor wheel.

The turbine housing 18 includes an inlet passage 26 that is coupled to an exhaust manifold (not shown) of the engine to receive an exhaust gas flow. The inlet passage 26 has the form of a volute and directs the exhaust gas flow into the turbine housing body 22 towards the turbine wheel 24. The exhaust gas flow rotatably drives the turbine wheel 24 on the shaft 20, thereby causing the compressor wheel to rotate also. After driving the turbine wheel 24, the exhaust gas flow is discharged through an outlet passage 30 of the turbine housing 18. This outlet passage 30 is also known as exducer.

In order to improve performance and efficiency of the turbocharger 10, it is common to regulate the exhaust gas flow to the turbine wheel 24 using a guide apparatus 32. The guide apparatus 32 is positioned within the turbine housing 18 and includes a plurality of guide vanes 34 located downstream of the inlet passage 26 and upstream of the turbine wheel 24. The space between adjacent guide vanes 34 defines a flow channel through which the exhaust gas flows to the turbine wheel 24. By varying an angular position of the guide vanes 34, a respective cross-section of the flow channels is adjustable.

The guide vanes 34 are arranged circumferentially around the turbine axis of rotation R1. Each guide vane 34 is supported between a first vane ring 38 and a second vane ring 40 by a pivot shaft 42. Alternatively, the guide vanes 34 may be supported by the pivot shafts 42 between the upper vane ring 38 and a ring-shaped wall of the turbine housing body 22. The pivot shafts 42, with the guide vanes 34 fixedly secured thereto, rotate to provide pivotal movement of the guide vanes 34.

At one of its two opposite ends, each pivot shaft 42 extends into a corresponding bore of the second vane ring 40. At its other end, each pivot shaft 42 penetrates through a corresponding bore of the first vane ring 38. A vane lever or vane fork 44 is fixedly secured to a distal end of each pivot shaft 42 away from the guide vane 34. The vane fork 44 extends generally perpendicular to the pivot shaft 42 and includes two spaced apart guide arms 46 with a recess therebetween.

In order to control an angular position of the guide vanes 34, an actuation device (not shown) is provided outside the housing assembly 12, which controls an actuation movement of a pestle member (not shown) that extends into the housing assembly 12. The actuation movement of the pestle member is transferred to a control or adjusting ring 48, which is positioned adjacent to the first vane ring 38. The actuation movement of the pestle member is converted into rotational movement of the control ring 48. The control ring 48 defines a control ring axis of rotation R2 that is coaxial with the turbine axis of rotation R1. Rotational movement of the control ring 48 about the control ring axis of rotation R2 in opposite first and second directions enables adjustment of the guide vanes 34 between an open or generally radially extending position and a closed or generally tangentially extending position. In this manner, the guide vanes 34 realize a VTG.

In FIG. 1, the guide vanes 34 are shown in their open position. In this open position, the guide vanes 34 extend generally radially relative to the turbine axis of rotation R1 to allow the exhaust gas to flow through the inlet passage 26 to the turbine wheel 24 at a high mass flow rate. In contrast, in the closed position, the guide vanes 34 extend generally tangentially relative to the turbine axis of rotation R1 to substantially block the exhaust gas from flowing through the inlet passage 26 to the turbine wheel 24 (corresponding to no or a low mass flow rate).

The outlet passage 30 is designed such that a high turbine performance can be realized in particular at high mass flow rates, as will be explained in greater detail below. At the same time, the outlet passage design is useful for applications with strong packaging constraints because the overall length of the outlet passage 30 can be kept low, which leads to a short overall length of the turbocharger 10.

As illustrated in FIG. 1, the outlet passage 30 has a longitudinal axis L that is coaxial with the turbine axis of rotation R1 and the control ring axis of rotation R2. In the embodiment of FIG. 1, the outlet passage 30 is rotationally symmetric relative to the longitudinal axis L. In other embodiments, the outlet passage 30 may have one or more sections that deviate from a rotationally symmetric shape.

In the embodiment illustrated in FIG. 1, no lateral openings are provided in the outlet passage 30. In other words, the outlet passage 30 has a closed internal surface.

The outlet passage 30 has a first section 50 including an inlet opening 52 configured to receive the exhaust gas flow from the turbine housing body 22. The first outlet passage section 50 includes an outlet opening 54 downstream of the inlet opening 52 and configured to discharge the exhaust gas flow from the first section 50. A length of the first outlet passage section 50 is defined by a distance between the inlet opening 52 and the outlet opening 54 of the first outlet passage section 50 along the longitudinal axis L of the outlet passage 30.

The outlet passage 30 further comprises a second section 56 downstream of and immediately adjacent to the first section 50. The second section 56 includes an inlet opening 58 configured to receive the exhaust gas flow from the first section 50 and an outlet opening 60 downstream of the inlet opening 58. The outlet opening 60 is configured to discharge the exhaust gas flow from the turbine housing 18. A length of the second outlet passage section 56 is defined by a distance between the inlet opening 58 and the outlet opening 60 of the second outlet passage section 56 along the longitudinal axis L of the outlet passage 30.

In a flow direction of the exhaust gas, the second outlet passage section 56 ends in a flange 62 that circumferentially surrounds the outlet opening 60. The flange 62 comprises multiple connection structures in the form of through-bores 64. The through-bores 64 are configured to receive bolts to connect the turbocharger 10 to a catalytic converter assembly (not shown).

As stated above, the overall geometrical shape of the outlet passage 30 has specifically been designed such that a high performance is realized at a low overall length of the outlet passage 30. This overall length is defined by the distance between the inlet opening 52 of the first outlet passage section 50 and the outlet opening 60 of the second outlet passage section 56 along the longitudinal axis L of the outlet passage 30. In general, the overall length is selected to lie within the range from 3 cm to 15 cm.

As illustrated in FIG. 1, the overall geometric shape of the outlet passage 30 is defined by a comparatively long, substantially tubular (or cylindrical) segment defined by the first outlet passage section 50 and a comparatively short flaring segment defined by the second outlet passage section 56. In more detail, the length of the second outlet passage section 56 is generally less than 50% of the length of the first outlet passage section 50. In typical realizations, the length of the second outlet passage section 56 will be less than 40% or less than 30% of the length of the first outlet passage section 50. It has been found that a significant flaring of the cross-sectional area of the outlet passage 30 over the comparatively short second outlet passage section 56 is expedient to maintain a high turbine performance while the overall length of the outlet passage 30 can be selected small.

With the inlet opening 52 of the first outlet passage section 50 having a first cross-sectional area and the outlet opening 60 of the second outlet passage section 56 having a second cross-sectional area in a plane perpendicular to the longitudinal axis L, that second cross-sectional area is typically at least 1.8 times greater than the first cross-sectional area. In certain realizations, the second cross-sectional area can be more than 2, 4 or 5 times greater than the first cross-sectional area.

In the following, the geometric parameters of the outlet passage 30 of the turbine housing 18 of FIG. 1 will be discussed in more detail with reference to the schematic cross-sectional view illustrated in FIG. 2. It is to be noted that certain details of FIG. 1, such as the flange 60 and the guide apparatus 32, have been omitted in FIG. 2 for ease of explanation.

Figure 2:
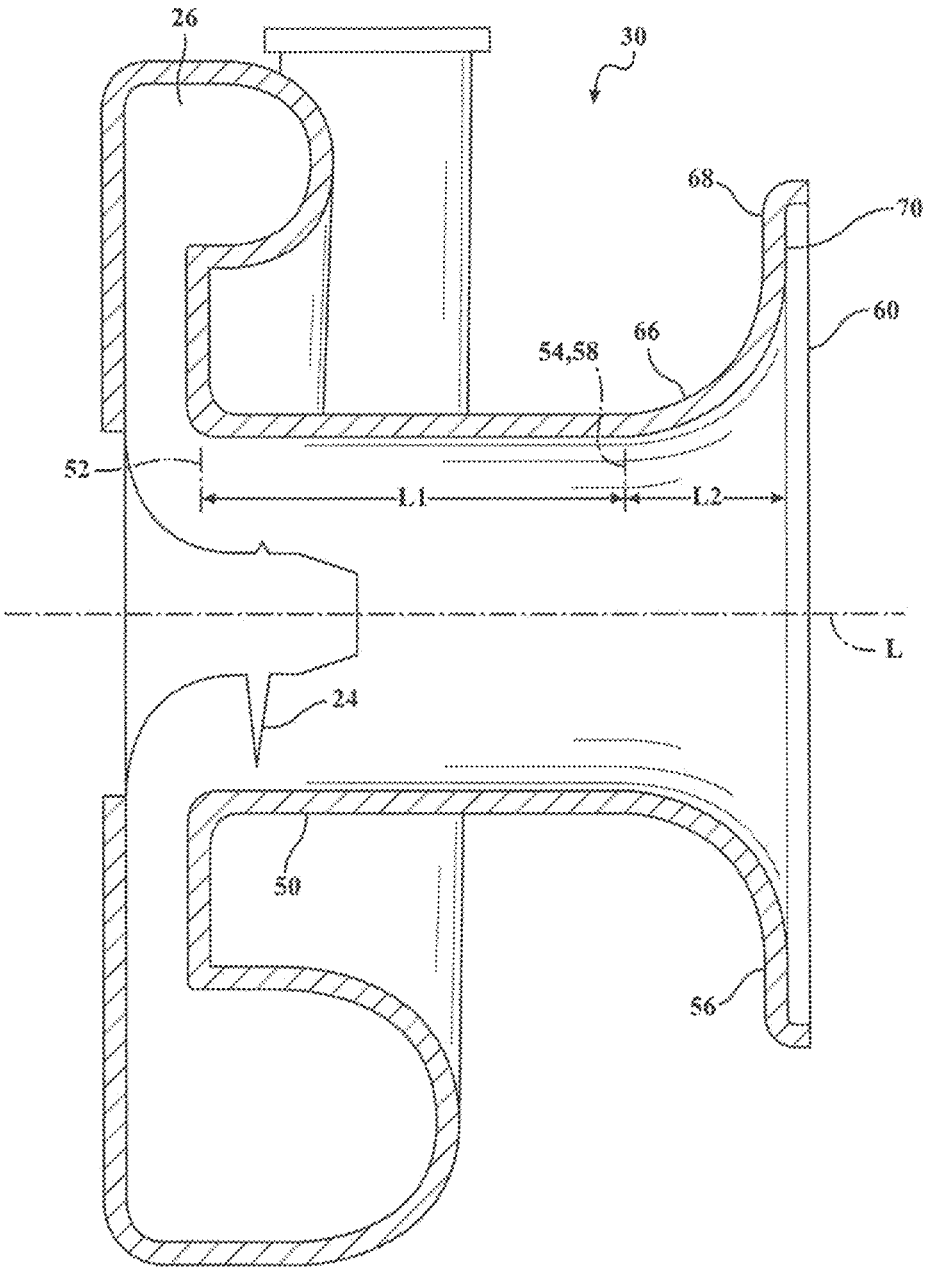
FIG. 2 is a schematic cross-sectional side view of an outlet passage design of the turbine housing of FIG. 1.

As shown in FIG. 2, the length L1 of the first outlet passage section 50 is defined by the distance between the inlet opening 52 and the outlet opening 54 of the first outlet passage section 50 along the longitudinal axis L of the outlet passage 30. A length L2 of the second outlet passage section 56 is defined in a similar manner by the distance between the inlet opening 58 and the outlet opening 60 of the second outlet passage section 56 along the longitudinal axis L of the outlet passage 30. It will be appreciated that, for example, the second outlet passage section 56 may have a longitudinal axis that is not coaxial with the longitudinal axis L of the outlet passage 30 as a whole. In such a case, the geometric parameters of the second outlet passage section 56, such as its length L2, will be defined relative to the longitudinal axis of the second outlet passage section 56.

In the embodiment of FIG. 2, and in other embodiments, the location of the inlet opening 52 of the first outlet passage section 50 is defined by the location at which the outlet passage 30 begins to assume a substantially tubular, or cylindrical, shape which then continues into the remainder of the first outlet passage section 50.

As is known in the art, there may exist a small step along the longitudinal extension of the first outlet passage section 50 as a result of the manufacturing process of the turbine housing 18. This step is the result of drilling or milling a space that accommodates the turbine wheel 24. The step is disregarded herein for the purpose of geometrically defining the parameters of the first outlet passage section 50.

The first outlet passage section 50 may slightly deviate from the generally tubular, or cylindrical, shape illustrated in FIGS. 1 and 2, in which an opening angle relative to the longitudinal axis L is approximately 0°. For example, the first outlet passage section 50 may open at an angle greater than 0° and less than 10°, or less than 5°, relative to the longitudinal axis L along its length L1.

In the embodiment of FIG. 2, and in other embodiments, the location of the outlet opening 54 of the first outlet passage section 50 is defined by the location downstream of the inlet opening 52 at which the outlet passage 30 begins to deviate from the substantially tubular, or cylindrical, shape. In the embodiment of FIG. 2, and in other embodiments, the location of the inlet opening 58 of the second outlet passage section 56 is defined by the location at which the outlet passage 30 begins to assume the flaring shape. In some embodiments, like in the embodiments illustrated in FIGS. 1 and 2, the locations of the outlet opening 54 of the first outlet passage section 50 and of the inlet opening 58 of the second outlet passage section 56 coincide, so that the two openings 54, 58 coincide as well.

In the embodiment of FIG. 2, and in other embodiments, the outlet opening 60 of the second outlet passage section 56 lies in a plane that defines a connection face of the flange 62 (see FIG. 1) towards the catalytic converter assembly (not shown) and that extends perpendicular to the longitudinal axis L.

As illustrated in FIG. 2, the second outlet passage section 56 has a first sub-section 66 defining the inlet opening 58 and a second sub-section 68 downstream of and immediately adjacent to the first sub-section 66. The second sub-section 68 defines the outlet opening 60.

The first sub-section 66 flares outwardly relative to the longitudinal axis L. In more detail, the first sub-section 66 flares outwardly at a predefined radius of curvature that can generally be selected to lie in the range from 0.3 cm to 4 cm. The start of the second sub-section 68 along the length L2 of the second outlet passage section 56 is defined by the location along the length L2 where the curvature of the flaring second outlet passage section 56 starts to exceed the predefined radius of curvature that defines the first sub-section 66.

Figure 3:
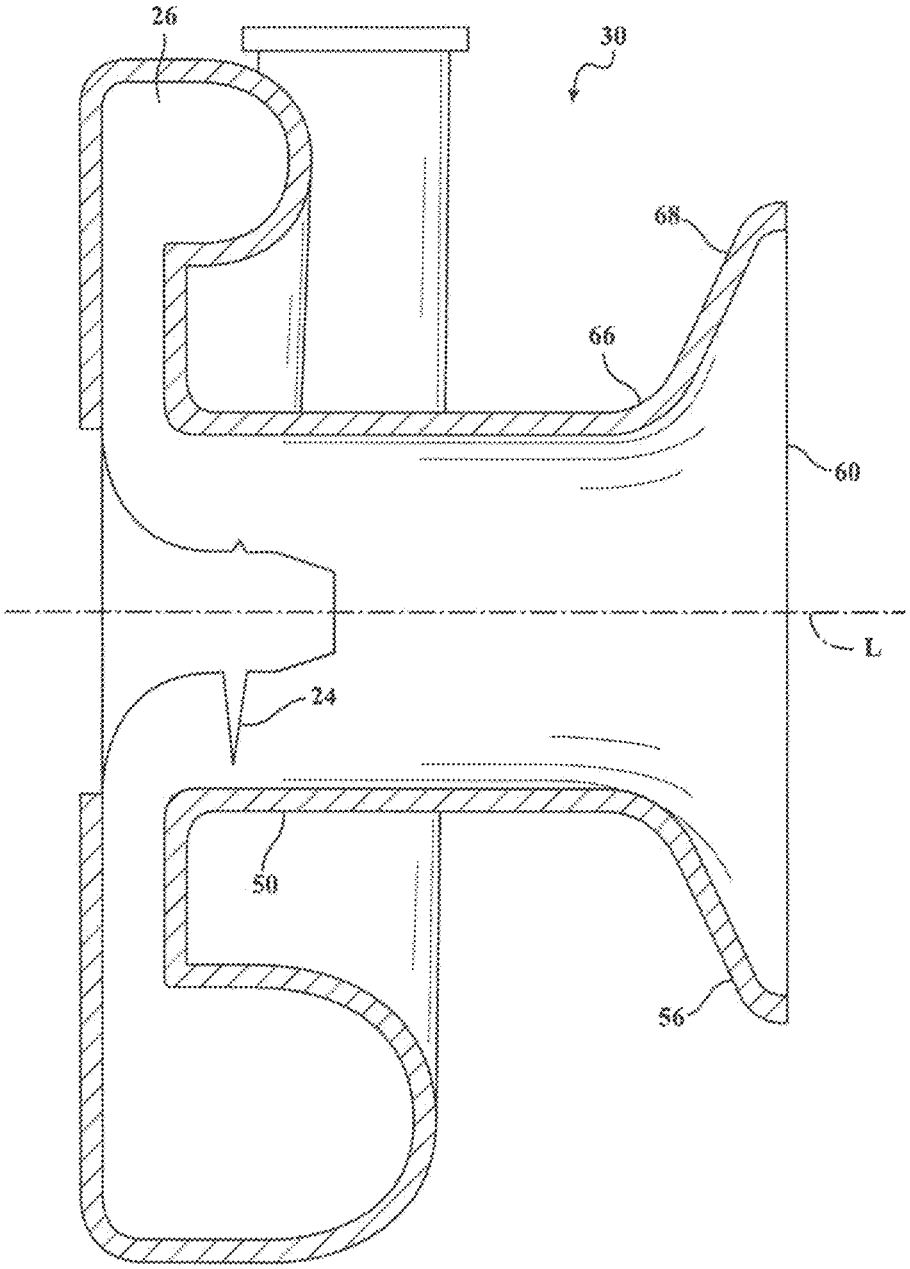
FIG. 3 is a schematic cross-sectional side view of an outlet passage design according to another turbine housing embodiment.

FIG. 3 shows a schematic cross-sectional side view of an alternative outlet passage design that may be used for the turbocharger 10 of FIG. 1. As illustrated in FIG. 3, the first sub-section 66 flares outwardly and the second sub-section 68 flares inwardly again towards the outlet opening 60. As such, the second outlet passage section 56 has an S-shape in the cross-sectional view of FIG. 3.

Figure 4:
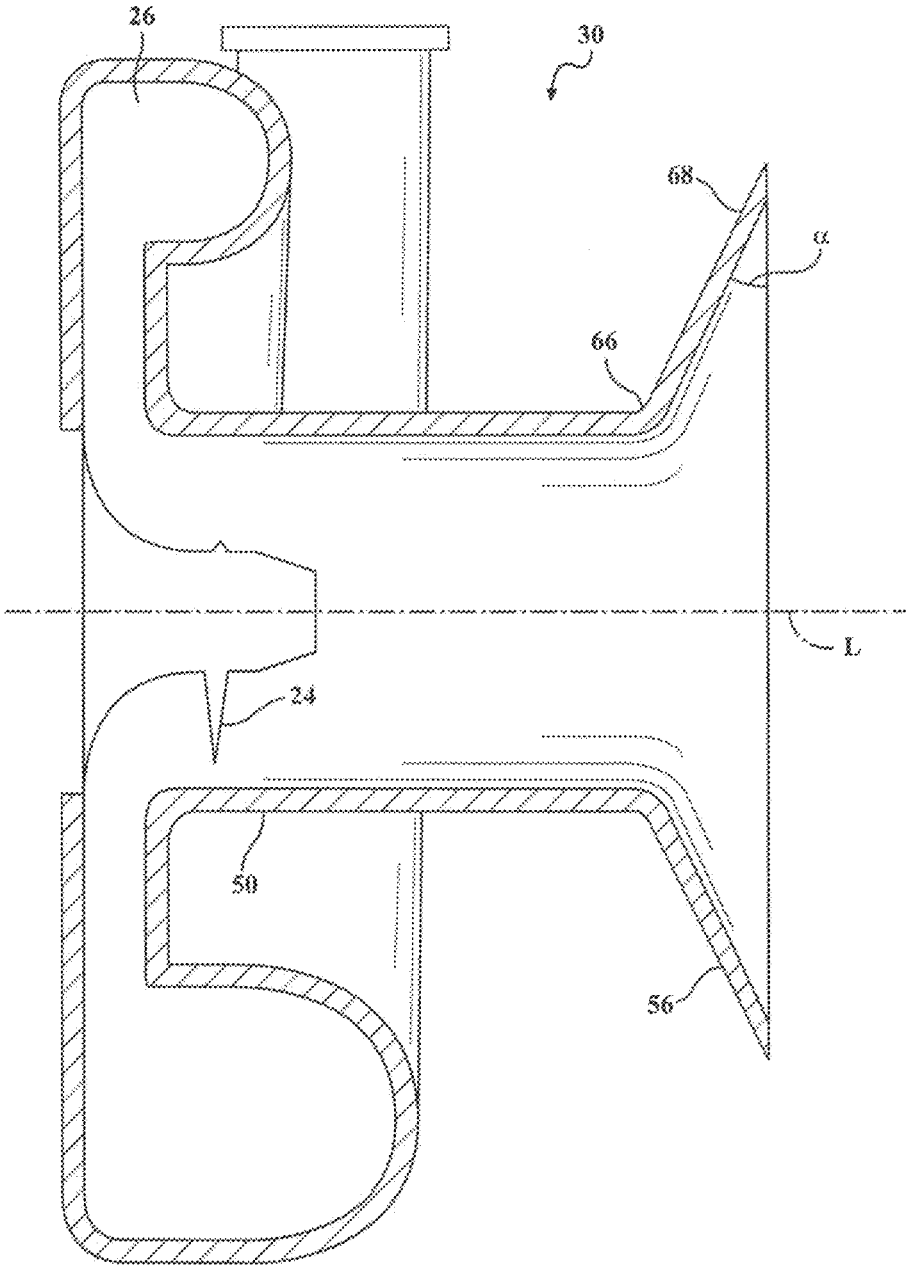
FIG. 4 is a schematic cross-sectional side view of an outlet passage design according to a still further turbine housing embodiment.

FIG. 4 shows a schematic cross-sectional side view of another alternative outlet passage design that may be used for the turbocharger 10 of FIG. 1. As illustrated in FIG. 4, the second outlet passage section 56 has a substantially conical shape with a linearly increasing diameter. In the embodiment of FIG. 4, the radius of curvature in the first sub-section 66 is significantly smaller than in the embodiments of FIGS. 2 and 3. This means that the length of the second outlet passage section 56 is substantially defined by the length of the conically shaped second sub-section 68.

There exist various possibilities how an internal wall 70 of the second sub-section 68 can merge into a plane extending parallel to (and optionally including) the outlet opening 60 of the second outlet passage section 56. This merging can be defined by a tangential angle of the internal wall 70 relative to that plane, and different realizations in this regard are illustrated in FIGS. 2 to 4, wherein the tangential angle $\alpha$ is specifically denoted only in FIG. 4.

The internal wall 70 may, for example, merge at a tangential angle of approximately 0° into that plane, as illustrated in FIG. 2. Alternatively, the internal wall 70 may merge at a tangential angle of approximately 90° into that plane, as illustrated in FIG. 3. As a still further alternative, the internal wall 70 may merge at a tangential angle $\alpha$ between 10° and 80°, for example of approximately 25°, into that plane, as illustrated in FIG. 4. In the scenarios illustrated in FIGS. 3 and 4, the plane comprises the outlet opening 60, whereas in the scenario illustrated in FIG. 2 the plane is minimally spaced apart from a plane defined by the outlet opening 60 compared to the length L2 of the second outlet passage section 56.

In embodiments of the present disclosure, the sum of L1 and L2 may generally be greater than 3 cm (e.g., greater than 5 cm). Moreover, the sum of L1 and L2 may generally be smaller than 15 cm (e.g., smaller than 10 cm).

In embodiments of the present disclosure, such as those illustrated in FIGS. 2 to 4, the inlet opening 52 may have a diameter greater than 2 cm (e.g., greater than 4 cm). Moreover, that diameter may be smaller than 12 cm (e.g., smaller than 9 cm). As an example, the diameter of the inlet opening 52 may approximately be 6 cm.

In embodiments of the present disclosure, the outlet opening 60 may generally have a diameter greater than 5 cm (e.g., greater than 7 cm). Moreover, that diameter may generally be smaller than 20 cm (e.g., smaller than 13 cm). As an example, the diameter of the outlet opening 60 may approximately be 9 to 11 cm.

The outlet opening 60 may have a circular or a non-circular (e.g., oval) shape. In case of a non-circular shape, the exemplary diameter dimensions mentioned above relate to the largest diameter of the outlet opening 60.

In the embodiments of FIGS. 2 to 4, the outlet opening 60 lies in a plane that extends perpendicular relative to the longitudinal axis L. In other embodiments, the outlet opening 60 may lie in a plane that extends obliquely relative to the longitudinal axis L. For example, the plane may be tilted by up to 10°, up to 20° or up to 30° relative the longitudinal axis L.

In the embodiments of FIGS. 2 to 4, the outlet opening 60 is rotationally symmetric relative to the longitudinal axis L. In other embodiments the outlet opening 60 may be rotationally symmetric relative to another axis that is parallel to and offset relative to the longitudinal axis L. This other axis may alternatively be non-parallel but tilted relative to the longitudinal axis L.

In the embodiments of FIGS. 2 to 4, the first section 50 and the second section 56 have a common longitudinal axis L that is coaxial with the turbine axis of rotation R1. In other embodiments, the second section 56 may have a longitudinal axis that is tilted relative to the turbine axis of rotation R1 and, thus, the longitudinal axis L. In such embodiments, the outlet opening 60 lie in a plane that is tilted relative to the longitudinal axis L.

Figure 5:
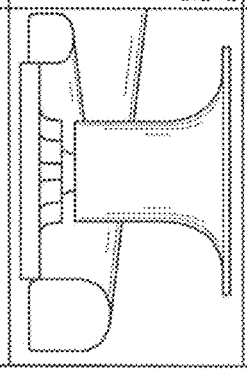
FIG. 5 presents in table form a comparison of performance parameters for the first outlet passage design illustrated in FIG. 2 and two comparative outlet passage designs.
Figure 5:
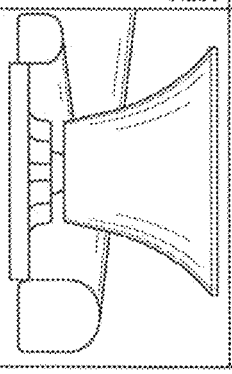
Figure 5:
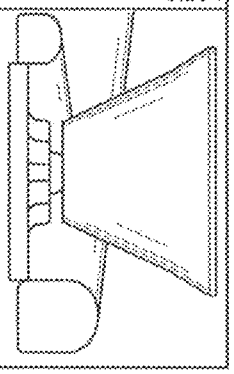

FIG. 5 presents in table form a comparison of performance parameters for the outlet passage design illustrated in FIG. 2 ("Design 1") and two comparative outlet passage designs ("Design 2" and "Design 3", respectively). All three outlet passage designs have the same cross-sectional areas at their respective inlet opening and outlet opening. The two comparative outlet passage designs each have a continuously increasing diameter from their inlet opening to their outlet opening, wherein the opening angle is in each case greater than 10° over the entire length of the respective outlet passage. In other words, compared to the outlet passage design presented herein, the two comparative outlet passage designs do not have a substantially cylindrical first section defining the inlet opening followed by a comparatively sudden expansion over a comparatively short second section defining the outlet opening.

The two comparative outlet passage designs deviate relative to each other in that the outlet passage diameter expansion of Design 3 increases substantially linearly, whereas the outlet passage diameter expansion of Design 2 increases more than linearly.

Simulation results have shown that the outlet passage design illustrated in FIG. 2, i.e., "Design 1" in FIG. 5, leads to a significant increase of turbine efficiency at high massflow rates (open VTG positions) compared to the comparative designs illustrated in FIG. 5. At the same time, the turbine efficiency at low massflow rates and more closed VTG positions is not strongly negatively affected by that design. The outlet passage design presented herein is therefore particularly useful for a turbocharger of the VTG type. Similar results are also obtained for the alternative outlet passage designs illustrated in FIGS. 3 and 4.

The significantly increased turbine efficiency of the outlet passage design illustrated in FIG. 2 is exemplarily expressed by the comparatively lower rated power pressure loss $\Delta p_t$, higher rated power isentropic efficiency $\eta_{Pe}$ and higher rated power operating point $P_{Pe}$ as illustrated in FIG. 5. At the same time, the rated torque pressure loss $\Delta p_t$, rated torque isentropic efficiency $\eta_{Md}$ and rated torque operating point $P_{Md}$ are not strongly negatively impacted. Here, $\eta_{Pe}$ and $\eta_{Md}$ stand for the isentropic efficiency $n_{sT}$ for rated power and rated torque, respectively.

Using the outlet passage design of FIG. 2, an indexing parameter $\theta_{CAT}$ of the catalytic converter downstream of the turbocharger 10 is also improved compared to Design 2 and Design 3, as illustrated in FIG. 5. The indexing paramater $\theta_{CAT}$ is defined as follows:

$$\theta_{CAT} = \frac{1}{h_{inlet}} * \sum_{i=1}^{n} h_{CAT_i} * \left(1 - \frac{r_i}{r_{max}}\right),$$

where $h_{inlet}$ is the static enthalpy upstream of the turbine housing 18, averaged over the cross-sectional area of the turbine entry surface. Assuming that the cross-section area of the catalytic converter entry surface is modeled as a numeric network of nodes i=1 to n that spani a circular area having a center, $r_i$ indicates the radial distance of node i from that center, and $h_{CATi}$ is the corresponding enthalpy. A normalization takes place over the radius $r_{max}$ of that circular area. In this manner, the enthalpies $h_{CATi}$ are weighted.

The above formula for the indexing parameter $\theta_{CAT}$ basically evaluates the energy going into the catalytic converter, weighted by the centricity on the catalytic converter entry surface (wherein hotspot on the center leads to quicker light-off). To compare the indexing parameters $\theta_{CAT}$ across different turbine designs, the parameter is normalized by the enthalpy of the exhaust gas coming into the turbine housing 18.

In this way, it becomes comparable how much energy is 'lost' through the turbine housing walls, gas expansion and conversion to mechanical energy by the turbine wheel 24.

Additional heat distribution simulations have shown a more centered hotspot relative to the longitudinal axis L for the outlet passage designs illustrated in FIGS. 2 to 4. The centered hotspot indicates less wetted surface area of the corresponding outlet passage 30 and, thus, less heat loss through the outlet passage walls.

In sum, the outlet passage design presented herein combines a comparatively short length with high turbine efficiency and high catalytic efficiency. As such, the outlet passage design is specifically suitable for applications with dense packaging constraints.

The invention has been described here in an illustrative manner, and it is to be understood that modifications and variations are possible in light of the above teachings. It is, therefore, to be understood that the invention may be practiced in other embodiments while still being covered by the claims that follow.

The invention claimed is:

1. A turbine housing (18) for a turbocharger (10), the turbine housing (18) comprising:

a turbine housing body (22) configured to house a turbine wheel (24);

an inlet passage (26) connected to the turbine housing body (22) and configured to receive an exhaust gas flow and direct the exhaust gas flow into the turbine housing body (22); and an outlet passage (30) connected to the turbine housing body (22) and configured to discharge the exhaust gas flow, the outlet passage (30) having a longitudinal axis (L) and comprising:

a first section (50) including:

a first inlet opening (52) configured to receive the exhaust gas flow from the turbine housing body (22), the first inlet opening (52) having a first cross-sectional area;

a first outlet opening (54) downstream of the first inlet opening (52) and configured to discharge the exhaust gas flow from the first section (50); and a first length (L1) between the first inlet opening (52) and the first outlet opening (54), wherein the first section (50) has an opening angle between 0° and 10° relative to the longitudinal axis (L) along the first length (L1);

a second section (56) downstream of the first section (50) and including:

a second inlet opening (58) configured to receive the exhaust gas flow from the first section (50);

a second outlet opening (60) downstream of the second inlet opening (58) and configured to discharge the exhaust gas flow from the turbine housing (18), the second outlet opening (60) having a second cross-sectional area that is at least 1.8 times greater than the first cross-sectional area; and a second length (L2) between the second inlet opening (58) and the second outlet opening (60), wherein the second length (L2) is less than 50% of the first length (L1), wherein the second section (56) defines a flange (62) configured to connect the outlet passage (30) to a catalytic converter assembly, wherein the second section (56) of the outlet passage comprises:

a first sub-section (66) defining the second inlet opening (58), the first sub-section (66) flaring outwardly; and a second sub-section (68) downstream of the first sub-section (66) and defining the second outlet opening (60), and wherein an internal wall (70) of the second sub-section (68) merges at a tangential angle between 0° and 10° into a plane extending parallel to the second outlet opening (60).

2. The turbine housing of claim 1, wherein the second length (L2) is less than 30% of the first length (L1).

3. The turbine housing of claim 1, wherein the sum of the first length (L1) and the second length (L2) is less than 15 cm.

4. The turbine housing of claim 1, wherein the second cross-sectional area is at least 2.2 times greater than the first cross-sectional area.

5. The turbine housing of claim 1, wherein the first sub-section (66) flares outwardly at a predefined radius of curvature.

6. The turbine housing of claim 1, further comprising:

a plurality of guide vanes (34) defining flow channels from the inlet passage (26) into the turbine housing body (22), at least some of the guide vanes (34) being adjustable so as to change a respective cross-section of at least some of the flow channels.

7. The turbine housing of claim 1, wherein at least one of the first section (50) and the second section (56) is rotationally symmetric relative to the longitudinal axis (L).

8. A turbocharger (10) comprising:

a compressor housing (14);

a turbine housing (18) according to claim 1; and a bearing housing (16) arranged between and connected to the compressor housing (14) and the turbine housing (18).

* * * * *